United States Patent [19]

Barker

[11] 4,455,969

[45] Jun. 26, 1984

[54] FLUIDIZED BED COMBUSTOR

[75] Inventor: Derek Barker, Fleet, England

[73] Assignee: The British Petroleum Company Limited, London, England

[21] Appl. No.: 508,329

[22] Filed: Jun. 27, 1983

Related U.S. Application Data

[63] Continuation of Ser. No. 337,440, Jan. 6, 1982, abandoned, which is a continuation of Ser. No. 127,875, Mar. 6, 1980, abandoned.

[30] Foreign Application Priority Data

Mar. 14, 1979 [GB] United Kingdom ..... 7908943

[51] Int. Cl.[3] ..... F22B 1/02

[52] U.S. Cl. ..... 122/4 D; 110/245

[58] Field of Search ..... 122/4 D; 110/245; 432/58, 14

[56] References Cited

U.S. PATENT DOCUMENTS

| | | | |
|---|---|---|---|
| 2,627,399 | 2/1953 | DeVaney | 432/14 |
| 2,884,373 | 4/1959 | Bailey | 122/4 D |
| 2,932,498 | 4/1960 | Metcalfe et al. | 432/58 |
| 3,111,942 | 11/1963 | Miller | 237/8 R |
| 3,366,080 | 1/1968 | Alkertson | 110/245 |
| 3,397,657 | 8/1968 | Tada | 110/245 |
| 3,466,021 | 9/1969 | Van Weert et al. | 432/58 |
| 3,605,655 | 9/1971 | Warshawsky et al. | 110/245 |
| 3,890,936 | 6/1975 | McIverney et al. | 237/8 R |
| 3,910,235 | 10/1975 | Highley | 122/4 D |
| 4,084,545 | 4/1978 | Nack et al. | 122/4 D |
| 4,136,642 | 1/1979 | Novotny et al. | 122/4 D |

FOREIGN PATENT DOCUMENTS

| | | | |
|---|---|---|---|
| 56-23623 | 3/1981 | Japan | 110/245 |
| 1368352 | 9/1974 | United Kingdom . | |
| 1487391 | 9/1977 | United Kingdom . | |

*Primary Examiner*—Henry C. Yuen

*Attorney, Agent, or Firm*—Morgan, Finnegan, Pine, Foley & Lee

[57] ABSTRACT

A fluidized bed combustor has its fluidizing chamber in thermal contact with a surrounding heat exchanger. A lined base portion of the chamber capable of containing the bulk of bed material while the bed is slumped is adapted to retard heat transfer from the bed. Thermostat linked devices in the bed and external load are arranged to switch the fuel and gas supplies to the bed so as to enable normal bed temperature to be attained without excessive heat removal to the heat exchanger.

10 Claims, 2 Drawing Figures

FLUIDIZED BED COMBUSTOR

This is a continuation of application Ser. No. 337,440 filed Jan. 6, 1982 abandoned which, in turn, is a continuation of application Ser. No. 127,875 filed Mar. 6, 1980 abandoned.

BACKGROUND OF THE INVENTION

The present invention relates to fluidised bed combustors.

It has been found that during use of conventional fluidised bed combustors having heat exchange jackets for connection to external heating systems there is sometimes an inability to raise the bed temperature to the normal working level of about 850° C. It is believed that this phenomenon is caused by the inability to limit the heat loss to the jacket from the combustor during warm-up and can lead to agglomeration and incomplete combustion in the fluidised bed.

The present invention is directed towards a fluidised bed combustor system which alleviates this problem by using a combustion chamber having a lined base portion to reduce heat removal during bed warm up and periods when the bed is slumped. Also the invention is directed towards a system for controlling the heat output of a fluidised bed combustor which avoids the need for the more usual techniques of load control such as bed temperature modulation and slumping of separate sections of the fluidised bed.

SUMMARY OF THE INVENTION

Thus, according to the present invention there is provided a fluidised bed combustor comprising a chamber capable of containing a fluidisable material, and being at least partially in thermal contact with a surrounding heat exchanger, or the like connected to an external load. The chamber has a lower portion which is adapted to retard the transfer of heat from the bed to the heat exchanger, and which has a volume capable of containing the greater part of the fluidisible bed material when the bed is slumped. Means for terminating fuel and fluidising gas flow to the bed when a pre-determined bed temperature or a pre-determined load temperature is attained and for resuming fuel and fluidising gas flow to the bed when one or both of the temperatures fall below its associated predetermined temperature are also provided.

A start up procedure is used to obtain fluidisation of the bed and to raise the bed to its operational temperature so as to allow the main fuel supply to be started. A start up burner, such as an overhead burner, most preferably projecting through the side walls of the combustion chamber, may be used for this purpose. The start up fuel may be, for example, fuel oil or gas.

The heat exchanger is preferably a water jacket, although a steam jacket may be used. The lower portion of the chamber is adapted to retard heat transfer from the fluidised bed to the heat exchanger means, preferably by making it from a refractory material, (e.g. castable refractory.) The refractory material is preferably divided into portions to facilitate assembly in the chamber. The refractory material is preferably a silica/alumina composition, (e.g. malochite). The heat exchanger may also include a heat pump passing through the walls of the boiler at a height above the level of the slumped bed material. When the bed is fluidised, this allows the heat pump to extract heat therefrom and transfer it to the load.

When the bed is slumped, it is preferred that 85% or more of the bed material be contained in the lower portion of the chamber.

The external load is preferably a system of radiators and/or heat exchangers, while the heat transfer fluid is preferably circulated, for example, by a mechanical pump.

Each of the means for terminating fuel and fluidising gas flow is preferably a thermostat with ancillary conventional control circuitry such as cut off valves, each thermostat being adapted to open and close the fuel and fluidising gas flows depending on its measurement of the associated determined temperature.

Any conventional fuel, such as oil, gas or coal, may be burned in the fluid bed combustor. During operation a load thermostat is set to switch off the fuel supply and the fluidising gas supply by closing the cut-off valves when a predetermined temperature of the heat transfer fluid, suitable for the particular application, is reached (e.g.for a hot water central heating system about 70°-85° C.). When the temperature of the fluid falls below this pre-determined temperature, the fuel and fluidising gas supplies are resumed by the thermostat opening the cut-off valves so as to recommence combustion.

A bed thermostat located in the lower portion of the fluid bed chamber terminates the fuel and fluidising gas supplies by closing the cut-off valves when the bed temperature exceeds a pre-determined maximum temperature.

In the start up mode of operation the bed thermostat in the lower portion of the chamber is arranged to over ride the load thermostat, which senses the boiler water temperature, if at the time the fuel and fluidising gas supplies are due to be switched on by the load thermostat, the temperature of the bed material is below the desired start up bed temperature, e.g. about 700° C. If the main fuel supply is resumed below this temperature then problems of incomplete combustion and bed agglomeration can occur particularly when using oil as a fuel. In order to alleviate these problems, the entire start-up procedure is repeated in this case.

Any conventional fuel, such as oil, gas or coal, may be burned in the fluidised bed combustor. The combustor may also be used for burning used automotive lubricants provided their heat content is sufficient for autothermal combustion. By use of a suitable fluidisible bed material and appropriate gas residence time, it is possible to retain within the bed a substantial proportion of metals such as lead in the oil and, also by use of a bed material such as limestone, sulphur, thereby reducing undesirable emission pollutants.

The preferred method of injecting fuel into the fluid bed combustor is the climbing oil film injection method described in our UK Pat. Nos. 1368352 and 1487391.

The lower portion of the chamber is preferably in the form of a single frusto-conical section containing a fuel injection means or a plurality of adjacent similar frusto-conical units.

DESCRIPTION OF THE DRAWINGS

The invention will now be described by way of example only with reference to FIGS. 1 and 2 of the accompanying drawings.

DESCRIPTION OF THE PREFERRED EMBODIMENT

Figure 1:
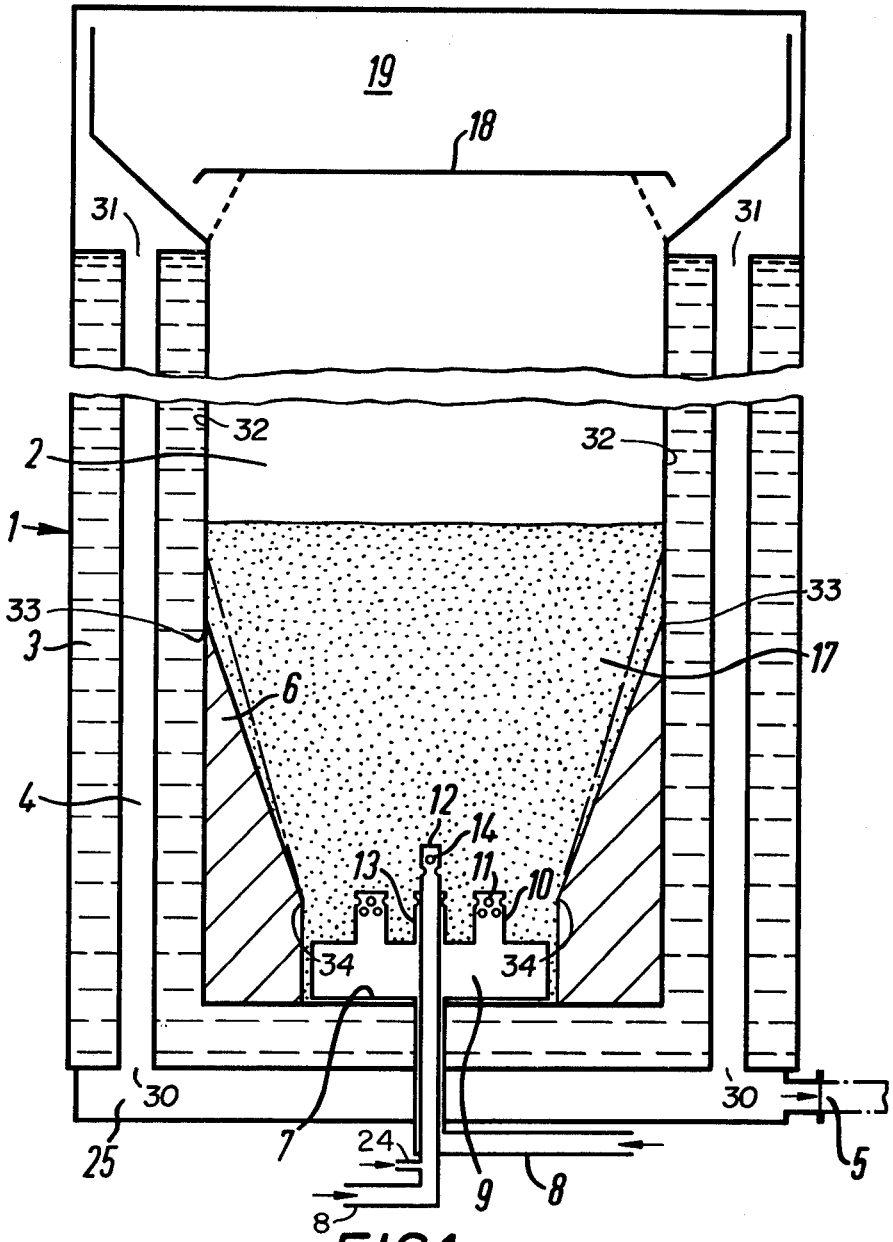
FIG. 1 shows a vertical diagrammatic cross-section of one embodiment of the fluidised bed combustor having a refractory lower portion and a surrounding water jacket.

The fluidised bed combustor comprises a vertical, mild steel, boiler shell 1 enclosing a combustion chamber 2. The boiler shell 1 has a water jacket 3 therein, through which pass smoke tubes 4 which communicate at one end 30 with a stack 5 and at the other end 31 with the combustion chamber 2.

Chamber 2 has the cross-section of a cylinder at the lower end in which the vertical walls 32 taper at 33 before passing vertically downwards again at 34 for a further distance. The tapered section takes the form of a refractory cone 6.

Figure 2:
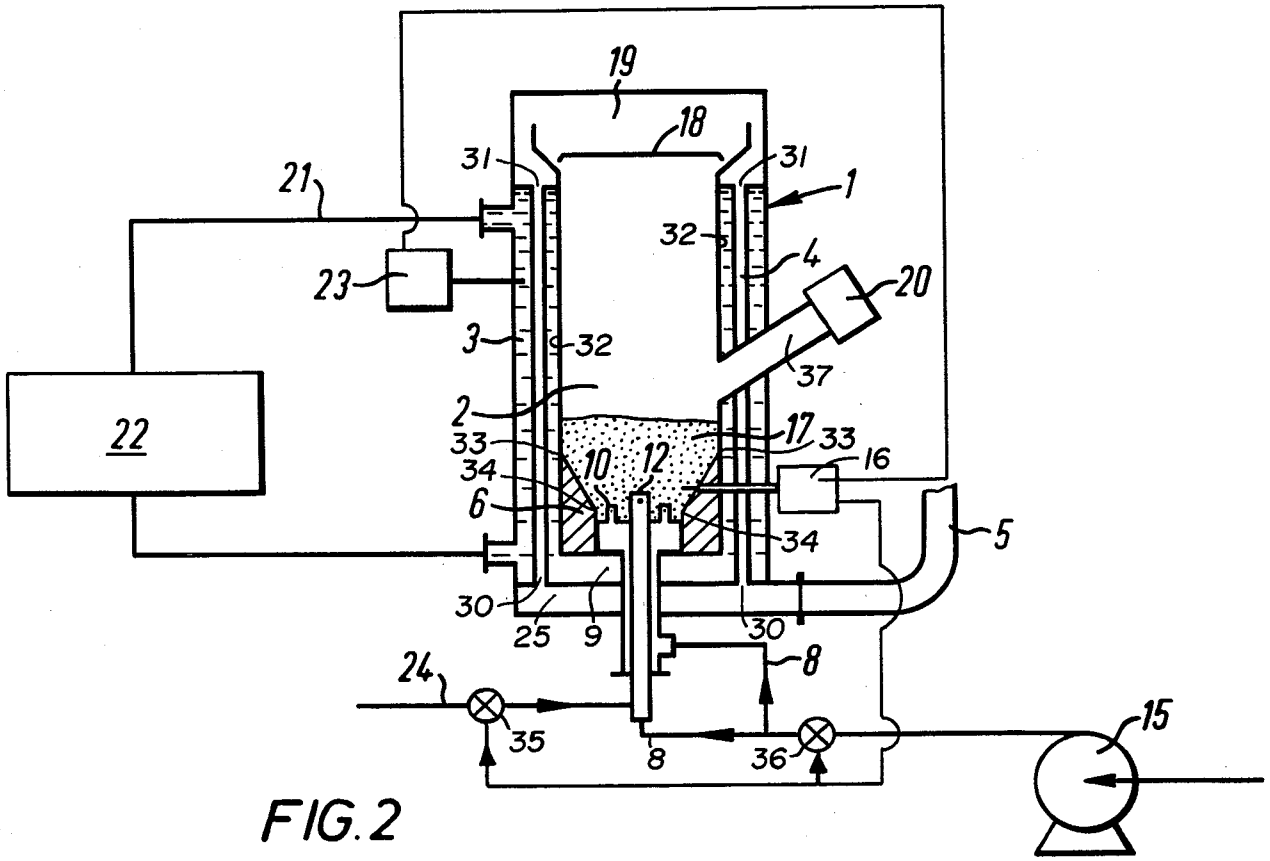
FIG. 2 shows a schematic layout of the fluidised bed combustor, the water jacket of which is connected to an external load.

A fuel/air injection system 7 is located in the base of chamber 2. The major portion of the air supply is fed via a single tube 8 passing through a smoke box 25 and water jacket 3 to plenum chamber 9 at the bottom of the chamber 2. Seven standard stub cap air nozzles, one nozzle 13 in the centre and six nozzles 10 equally spaced about a circle of 0.12 meters diameter, communicate with an project upwardly from the plenum chamber 9, and have their lateral outlets 11 in the combustion chamber 2. The central stub cap air nozzle 13 also carries a co-axial climbing oil film nozzle 12 of 0.018 meters diameter which projects beyond the air nozzle 13 into the combustion chamber 2. Oil is fed to nozzle 12 along fuel supply line 24, and the lateral outlets 14 of the oil nozzle 12 are located at a short distance above the level of the air nozzle outlets 11. The air is supplied to the air nozzles and fuel nozzle by means of a forced draught fan 15 through air supply lines 8. The refractory cone base portion 6 of the combustion chamber 2 contains a bed temperature thermostat 16, (FIG. 2) which is linked to the fuel and air supplies of the boiler by means of cut-off valves 35 and 36, respectively.

The fluidised bed material 17 contained in the combustion chamber 2 is a sand/limestone mixture, or sand, dolomite or malochite or a mixture of two of these. The size of the bed particles is of the order 600–1200 microns. To minimize elutriation of bed material by the fluidising gas flow, a baffle arrangement 18 is mounted in the free board space 19 above the bed. For start up purposes, an oil fired overhead burner 20 (FIG. 2) is mounted in a position above the slumped bed 17 in a ceramic lined tunnel 37 passing through the water jacket so that the burner 20 is partially protected from the hot combustion zone. The burner 20 may consume gas oil or fuel gas and has a conventional spark ignition and a conventional control circuit with a flame sensor to ensure that fuel is only supplied if the burner is activated.

The water jacket 3 of the boiler shell 1 is connected by pipes 21 to an external load 22, e.g. radiators and/or heat exchangers. A load thermostat 23 connected to the water jacket 3 is linked indirectly to the fluid bed fuel 24 and air supply lines 8.

During use of the combustor, the air supply to the fluidising air and oil nozzles 10, 13 and 12 is turned on and the overhead burner 20 is ignited. The bed 17 is heated up by radiation from the overhead burner 20 and becomes progressively fluidised from its upper surface downwards. As this occurs the bed particles begin to circulate and transfer more heat into the body of the bed 17. During this warmup period, some heat passes into the water jacket 3 from the overhead burner 20 and the combustion gases as they pass through the freeboard 19 and smoke tube 4.

When a bed temperature of 650° C. is sensed by the thermocouple or bed temperature sensor or thermostat 16, the oil supply to the climbing oil film nozzle 12 is started by thermostat 16 opening cut-off valve 35; and satisfactory in-bed combustion must be established in a time set by a fast acting thermocouple. Thus, if a satisfactory indication is not received within, say 4 seconds, the oil supply is stopped. When satisfactory combustion is attained the overhead or pilot burner 20 is switched off. The jacket 3 of the boiler shell 1 is heated directly by the bed and additionally by heat exchange with the flue gases passing through smoke tubes 4.

Load control is effected by operating the unit at either nominal full load or with no fuel or air being supplied, i.e. "on" or "off" modes.

When modulation of heat input is required (indicated by load thermostat 23 sensing the water temperature to be above its associated predetermined temperature), the oil and air supplies are switched off and the bed collapses into the insulated conical refractory base 6 of the chamber. The rate of heat loss from the bed thus being minimised. When the water temperature has fallen below the pre-determined temperature, this indicates the need to recommence firing, and the air and oil supplies will be re-established by thermostat 23 to obtain in-bed combustion as before.

The fuel used in the example was a mixture of used automotive lubricants having the characteristics shown in Table 1. Table 2 is a specification of the fluidised bed combustor system. Table 3 is a summary of the characteristics of the fluid bed combustion system used in the example for two unit outputs.

TABLE 1

| | | |
|---|---|---|
| Density at 15° C. | g/cm$^3$ | 0.91 |
| Calorific value (gross) | MJ/kg | 43.5 |
| Calorific value (net) | MJ/kg | 41.1 |
| Kinematic vescosity at 37.8° C. | cST | 85 |
| Ash content at 850° C. | % wt | 1.0 |
| Barium content | % wt | 0.3 |
| Lead content | % wt | 0.2 |
| Phosphorous content | % wt | 0.1 |
| Sulphur content | % wt | 1.2 |
| Zinc content | % wt | 0.1 |

TABLE 2

| | | |
|---|---|---|
| Fuel | | Used lubricant |
| Unit output | MJ/h | 375–485 |
| Heat transfer medium | | Water |
| Inlet temperature | °C. | 60 |
| Outlet temperature | °C. | 80 |
| Bed temperature | °C. | 850 |
| Flue gas exit temperature | °C. | 200 |

TABLE 3

| Unit output | Mj/h | 375 | 485 |
|---|---|---|---|
| Fuel input | kg/h | 10.10 | 13.06 |
| Excess air | % | 15 | 15 |
| Fluidising velocity | m/s | 0.87 | 1.13 |
| Bed temperature | °C. | 850 | 850 |
| Bed particle size range | micron | 600–1000 | 600–1200 |
| Bed depth (slumped) | m | 0.44 | 0.54 |
| Bed depth (fluidised) | m | 0.58 | 0.71 |
| Combustion chamber diameter | m | 0.47 | 0.47 |
| Combustion chamber height | m | 1.83 | 1.83 |

TABLE 3-continued

| Unit output | Mj/h | 375 | 485 |
|---|---|---|---|
| Freeboard height | m | 1.25 | 1.12 |
| Smoketube length | m | 2.08 | 2.08 |
| No. of smoketubes | | 5 | 6 |
| No. of oil nozzles | | 1 | 1 |
| No. of air nozzles | | 7 | 7 |
| Injection zone configuration | | Conical base | Conical base |
| Bed plan area at base of cone | $m^2$ | 0.052 | 0.052 |
| Cone angle with horizontal | degrees | 69.3 | 73.4 |
| Fluidising velocity at mean plane of oil injection | m/s | 2.3 | 3.1 |
| Oil transport air | % total | 20 | 20 |
| Minimum bed temperature for oil injection | °C. | 650 | 650 |
| Heat transfer medium | °C. | Water | Water |
| Water inlet temperature | °C. | 60 | 60 |
| Water outlet temperature | °C. | 80 | 80 |
| Water flow rate | kg/s | 1.25 | 1.61 |

I claim:

1. A fluidised bed combustor comprising:

a chamber containing a bed of fluidisible material, the chamber comprising an upper portion in thermal contact with a heat exchanger connected to an external load, and a lower portion having a lining for retarding heat transfer fron the bed to the heat exchanger, the lined lower portion having a volume capable of containing the greater part of the fluidisible bed material when the bed is slumped; and means for terminating and resuming fuel flow and fluidising gas flow to the bed, the terminating and resuming means terminating fuel flow and fluidising gas flow to the bed when a pre-determined bed temperature or a pre-determined load temperature is attained, and resuming fuel flow and fluidising gas flow to the bed when one or both of the temperatures falls below its said predetermined temperature;

said means for terminating and resuming fuel flow and fluidising gas flow being at least one thermostat with ancillary control circuitry for opening and closing the fuel and fluidising gas flows;

said at least one thermostat further including a load thermostat which is connected to the heat exchanger, and which terminates fuel flow and fluidising gas flow when the pre-determined load temperature is attained and which resumes fuel flow and fluidising gas flow when the load temperature falls below said pre-determined temperature, and where the bed thermostat in the lower portion of the chamber overrides the load thermostat if at the time the fuel and fluidising gas flows are due to be switching on by the load thermostat, the temperature of the bed material is below a desired pre-determined start-up bed temperature.

2. A fluidised bed combustor according to claim 1 in which the heat exchanger is a steam or water jacket or a heat pump.

3. A fluidised bed combustor according to claim 1 or claim 2 in which the lower portion of the chamber comprises a refractory material which is a silica/alumina composition.

4. A fluidised bed combustor according to claim 3 in which the refractory material is divided into portions to facilitate assembly.

5. A fluidised bed combustor according to claim 3 in which the lower portion of the chamber if frusto-conical in shape.

6. A fluidised bed combustor according to claim 1 or claim 2 in which said volume of said lower portion is capable of containing 85% or more of the bed material when the bed is slumped so that the heat loss from the bed is minimized.

7. A fluidised bed combustor according to claim 1 in which the ancillary control circuitry comprises one or more cut-off valves.

8. A fluidised bed combustor according to claim 1 in which the at least one thermostat is a bed thermostat located in the lower portion of the fluidisible bed chamber which resumes fuel flow and fluidising gas flow when the bed temperature falls below said pre-determined temperature and terminates said flows above said pre-determined temperature.

9. A fluidised bed combustor according to claim 1 or claim 2 in which the chamber contains a bed material from the group comprising sand, dolomite or molochite or a mixture of two of these components.

10. A fluidised bed combustor according to claim 1 or claim 2 further comprising an overhead start up burner for heating the bed of fluidisible material to a pre-determined start-up bed temperature.

* * * * *